US005172707A

United States Patent [19]

Zambelli

[11] Patent Number: 5,172,707

[45] Date of Patent: Dec. 22, 1992

[54] PROCESS FOR THE EXPANSION OF TOBACCO

[75] Inventor: Alessio Zambelli, Treviso, Italy

[73] Assignee: Comas S.p.A., Silea-Trevios, Italy

[21] Appl. No.: 674,527

[22] Filed: Mar. 22, 1991

[30] Foreign Application Priority Data

Apr. 4, 1990 [DE] Fed. Rep. of Germany ..... 4010892

[51] Int. Cl.[5] ..... A24B 3/18

[52] U.S. Cl. ..... 131/296; 131/291; 131/900

[58] Field of Search ..... 131/296, 291, 900

[56] References Cited

U.S. PATENT DOCUMENTS

| | | | |
|---|---|---|---|
| 4,235,250 | 11/1980 | Utsch | 131/296 |
| 4,310,006 | 1/1982 | Hibbitts et al. . | |
| 4,336,814 | 6/1982 | Sykes et al. . | |
| 4,431,011 | 2/1984 | Rothchild | 131/296 |
| 4,460,000 | 7/1984 | Steinberg | 131/291 |
| 4,528,994 | 7/1985 | Korte et al. | 131/296 |
| 4,630,619 | 12/1986 | Korte et al. | 131/296 |

FOREIGN PATENT DOCUMENTS

| | | |
|---|---|---|
| 0100590 | 2/1984 | European Pat. Off. . |
| 79/00857 | 11/1979 | PCT Int'l Appl. . |

*Primary Examiner*—V. Millin
*Assistant Examiner*—Lynne A. Reichard
*Attorney, Agent, or Firm*—Darby & Darby

[57] ABSTRACT

A process for the expansion of tobacco, wherein in step (a) the tobacco is cooled by being mixed with cold carbon dioxide; (b) the cooled tobacco is impregnated with liquid carbon dioxide through treatment with gaseous carbon dioxide under a predetermined pressure; (c) the liquid carbon dioxide condensed in the tobacco is converted to solid carbon dioxide through pressure reduction; and (d) the tobacco containing solid carbon dioxide is subjected to a hot gas treatment to achieve the expansion. In step (a) the tobacco is cooled to a temperature of −30° C. to −100° C. through expansion of liquid carbon dioxide and the simultaneous mixing of the tobacco therewith.

24 Claims, 1 Drawing Sheet

PROCESS FOR THE EXPANSION OF TOBACCO

BACKGROUND OF THE INVENTION

The present invention relates to a process for the expansion of tobacco, wherein (a) the tobacco is cooled to a predetermined temperature by mixing it with cold carbon dioxide in a predetermined weight ratio, (b) the cooled tobacco is impregnated with liquid carbon dioxide formed by condensing gaseous carbon dioxide at a predetermined pressure and for a predetermined contact period, (c) the liquid carbon dioxide condensed in the tobacco is converted to solid carbon dioxide through rapid reduction of the carbon dioxide pressure to form simultaneously gaseous carbon dioxide, and (d) the tobacco containing solid carbon dioxide is subjected to a hot gas treatment to achieve the expansion.

Such a process is known from DE-A 34 45 752 (=U.S. Pat. No. 4,528,994). In all steps of this process, carbon dioxide is used which is present in solid, liquid or gaseous form depending on the requirements and reaction conditions. The first step is carried out with sufficient solid carbon dioxide so that in the subsequent step wherein the tobacco is treated with pressurized gaseous carbon dioxide there is present a mixture of solid carbon dioxide and tobacco. The weight ratio between solid carbon dioxide and tobacco is preferably 96%/130%, and especially 125%/128%, so that there is a sufficiently high-percentage increase of the filling capacity of the tobacco in the final expansion carried out by hot gas treatment.

Due to the very high demand for carbon dioxide, especially solid carbon dioxide, this known process is not only uneconomical but, because of the high amount of carbon dioxide used, has the disadvantage that this excess solid carbon dioxide leads, during the subsequent treatment of the mixture of solid carbon dioxide and tobacco with gaseous carbon dioxide, to the formation of excess liquid carbon dioxide. The consequence thereof is that the liquid carbon dioxide is not selectively absorbed substantially only in the pores and on the porous surface of the tobacco. Furthermore, there is involved the risk of the formation of tobacco lumps due to icing caused by excessive carbon dioxide.

A corresponding process for the expansion of tobacco is also known from DE-A 34 45 753 (=U.S. Pat. No. 4,630,619). This process differs from the process of DE-A 34 45 752 mainly by the feature that in the first step the tobacco is cooled through a treatment with liquid nitrogen, so that in the subsequent step of treatment with gaseous carbon dioxide one will obviously have to apply a relatively high pressure. In this prior art process, nitrogen is entrained during the cooling step so that in the subsequent steps there are always formed gas mixtures consisting of nitrogen and carbon dioxide. An economic recovery and recycling of carbon dioxide is, therefore, not possible. In addition, this process involves the aforementioned disadvantages of the process of DE-A 34 45 752, as again there is no selective absorption of liquid carbon dioxide. There is also involved the formation of excessive solid carbon dioxide and subsequent production of excessive liquid carbon dioxide.

BRIEF DESCRIPTION OF THE INVENTION

It is the object of the present invention to provide a novel process for the expansion of tobacco, this process being extremely economical due to the especially low requirement and consumption of carbon dioxide and the recyclability thereof. This process selectively impregnates substantially only the pores and the porous surface of the tobacco, and leads at the same time to a tobacco having a greatly increased filling capacity.

The process of the present invention solves the problems of the prior art by cooling the tobacco in step (a) to a temperature of approximately −30° C. to −100° C., preferably approximately −70° C. to −85° C., through direct expansion of liquid carbon dioxide from a pressure tank into the interior of a closed system. A foggy mixture of cold gaseous carbon dioxide, carbon dioxide snow and optionally liquid carbon dioxide are formed which is simultaneously admixed with the tobacco.

The use of liquid carbon dioxide in step (a) and the above-described cooling of the tobacco may be the reason the tobacco in this first step has certain physical properties which, in the subsequent steps, are responsible for a selective absorption of the liquid carbon dioxide substantially only in the pores and on the porous surface of the tobacco and for the specific increase in the filling capacity of the tobacco. The use of a foggy mixture formed through direct expansion of liquid carbon dioxide in step (a) of the process of the present invention is therefore assumed to be of decisive importance for the further steps of this process. It is assumed that because of step (a) the structure of the tobacco is influenced and possibly fixed in an unique manner.

According to the process of the present invention, the weight ratio between the liquid carbon dioxide to be expanded and the tobacco to be cooled in step (a) is selected carefully so that, after the heat is withdrawn from the tobacco (having reached the temperature desired), the carbon dioxide snow present in the initial foggy mixture has been converted to gaseous carbon dioxide. The amount of residual carbon dioxide snow, prior to the subsequent step (b), is up to 40 percent by weight, preferably only up to 10 percent by weight, related to the weight of the cooled tobacco. In general, the amount of carbon dioxide snow still present is inversely proportional to the temperature of the tobacco at the beginning of step (b). For example, if the temperature of the tobacco is from approximately −30° C. to −70° C., the amount of residual carbon dioxide snow is from 40 to 10 percent by weight. Where the tobacco temperature is −70° C. to −85° C., e.g., less than 10 percent by weight of residual carbon dioxide snow is present. Preferably no residual carbon dioxide snow is then present.

DESCRIPTION OF THE FIGURE

The FIGURE shows a schematic diagram of an apparatus which may be used in practicing the process of the invention.

DETAILED DESCRIPTION OF THE INVENTION

Figure 1:
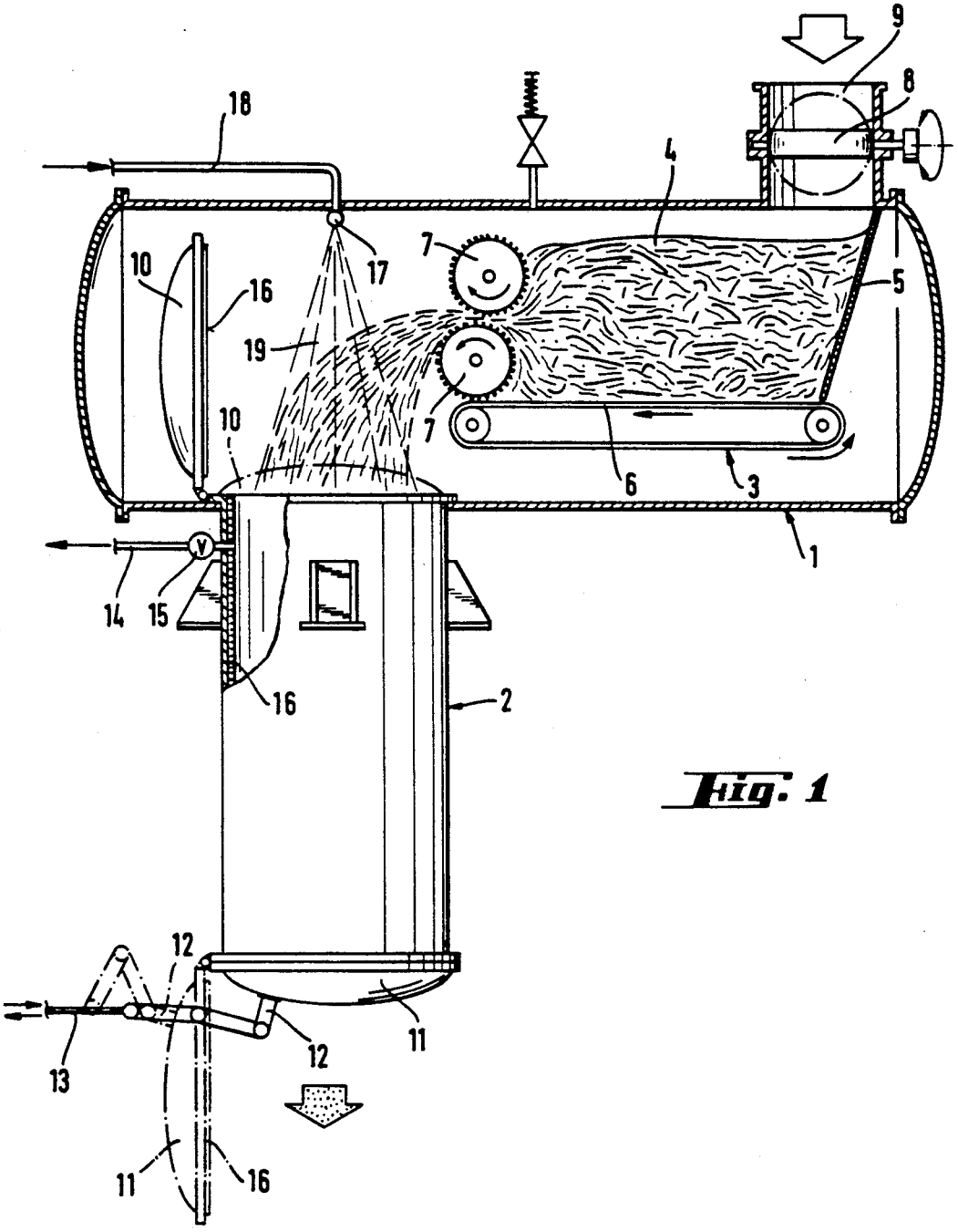

In a preferred embodiment, step (a) of the process of the present invention is conducted in such a manner that the weight ratio between liquid carbon dioxide to be expanded and tobacco is such that when the tobacco reaches the temperature of, preferably, approximately −70° C. to −100° C., especially approximately −70° C. to −85° C., most especially approximately −78° C., practically no carbon dioxide snow is present. In such case, the total of the carbon dioxide snow initially present is evaporated to gaseous carbon dioxide. Such an equilibrium allows an optimum performance of the process, a maximum increase of the filling capacity of the tobacco and at the same time an especially economical method of reducing the required amount of carbon dioxide, particularly that of the initially required liquid carbon dioxide. Avoided too are the troublesome additional formation of solid carbon dioxide and the subsequent conversion thereof to excessive liquid carbon dioxide when the cooled tobacco is treated with gaseous carbon dioxide. It will be understood that after step (a) when the tobacco has reached the desired temperature there may still be present a small amount of solid carbon dioxide which has not been evaporated to gaseous carbon dioxide. In general, however, in the optimal process of the present invention, practically all of the solid carbon dioxide is converted to gaseous carbon dioxide.

In step (a) of the process of the present invention the weight ratio between liquid carbon dioxide to be expanded and tobacco to be cooled will be approximately 0.4 to 1.8, preferably approximately 0.7 to 1.0.

The expansion of the liquid carbon dioxide from the respective pressure tank into the interior of a closed system (while simultaneously admixing the tobacco to be cooled) is carried out at a pressure sufficient to form the required foggy mixture, namely at an absolute pressure of generally less than approximately 6 bar, preferably approximately 0.2 to 1.0 bar (absolute pressure). This way the preferred low temperatures can generally be reached. The expansion of the liquid carbon dioxide can be carried out in a manner familiar to those skilled in the art. In general, such expansion is carried out through an expansion valve which controls the expansion as required for the formation of the foggy mixture.

A suitable heat insulation will ensure that the total coldness of the foggy mixture formed during the expansion of liquid carbon dioxide is used for cooling the tobacco and that there will not be any unnecessary consumption of coolant through heat transmission into other parts of the system or into the environment.

This is accomplished by appropriate insulation. For example, in the container where the tobacco is cooled, such an insulation is most suitably an interior lining. Such an interior heat-insulating lining is also of special importance for the container used in step (b), i.e., where the cooled tobacco is treated with gaseous carbon dioxide.

Prior to the initiation of step (a) of the process of the present invention, the mixing tank is preferably evacuated to remove the major part of the air so that contamination of the carbon dioxide which is recycled is kept at a low level. This procedure also helps the later impregnation of the tobacco pores by possibly liberating air therefrom. The mixing tank wherein step (a) is carried out (or the duplex tank system where both step (a) and step (b) are carried out) may be suitably evacuated to a pressure of approximately 3 to 8 mbar, preferably to a pressure of 4 to 6 mbar.

The tobacco to be treated according to the process of the present invention may be any tobacco material obtained from crushed or ground tobacco stems or tobacco ribs, such as so-called "reconstituted tobacco". However, the process is preferably employed to process tobacco leaves, particularly cut tobacco.

The humidity of the tobacco used as starting material for the process of the present invention is not critical. Suitably, this tobacco has a humidity of 10 to 25 percent by weight.

The period during which the tobacco is in contact with the foggy mixture in step (a) is in general approximately 2 to 12 minutes, preferably approximately 4 to 8 minutes, before step (b) is started.

The liquid carbon dioxide is fed directly from a pressure tank into a mixing tank wherein the foggy mixture is formed. To ensure optimal performance of step (b) the pressure tank is provided with a heat insulation, most suitably a heat-insulating lining disposed over the inner walls thereof. This measure ensures that the gaseous carbon dioxide required in step (b) is not condensed on the walls of the pressure tank, but rather substantially exclusively condenses in the pores of the tobacco or also limitedly on the porous surface of the tobacco. The formation of excessive liquid carbon dioxide would result in the soaking of the tobacco and not selective impregnation.

The steps (a), (b) and (c) of the process of the present invention are suitably carried out in a device wherein the mixing tank and the pressure tank define a pressure-tight and vacuum-tight duplex container system. Suitably, one employs a horizontally extending, box-shaped or tubular mixing tank. One half thereof houses the conveying means which receives the required amount of tobacco. The other half serves as the upper portion of the pressure tank. The pressure tank is provided with a lid which can be actuated from the interior of the mixing tank; i.e., it can be opened and closed both vacuum-tight and pressure-tight. This tank is preferably a cylindrical container having a bottom which can also be closed vacuum-tight and pressure-tight. Therefore, this pressure tank, when its lid and bottom are closed, can be pressurized with gaseous carbon dioxide to the pressure as required for the performance of step (b). Like the walls of the pressure tank, the lid and the bottom are preferably provided with an inner heat-insulating lining.

Prior to the formation of the foggy mixture, the closed duplex tank system, with the tobacco contained therein, is preferably evacuated to the aforementioned pressures. At this time, the lid of the pressure tank is opened towards the interior of the mixing tank. The bottom of the pressure tank, as well as the tobacco feed inlet, is closed.

The tobacco conveying means is preferably a tub disposed below the tobacco feed inlet. On the bottom of the tub is a conveyor belt. The outlet end faces the center of the mixing tank and includes a proportioning device for feeding directly into the top of the pressure tank the amount of tobacco corresponding approximately to the amount to be treated in the pressure tank during steps (b) and (c). The pipe line for the introduction of liquid carbon dioxide and the expansion valve located at the end thereof are preferably located in the walls of the mixing tank such that the expansion valve extends directly towards the opening of the pressure tank. In this way, the foggy mixture of cold gaseous carbon dioxide, solid carbon dioxide snow and optionally also some liquid carbon dioxide is mixed immediately after its formation with the proportioned amount of tobacco supplied by the conveying means and is fed to the pressure tank in an already intermixed state.

The evacuation of the duplex tank system for the performance of steps (a), (b) and (c) optionally to be carried out prior to step (a) of the process. It can be achieved by any suitable method, e.g., through a valve provided at the pressure tank, this valve being associated with a vacuum pump via a duct. A corresponding valve may be provided at the mixing tank.

For performing step (b) of the process of the present invention, gaseous carbon dioxide from a pressure vessel is added to the tobacco cooled to the desired temperature of approximately −30° C. to −100° C., preferably approximately −70° C. to −85° C., until a pressure of approximately 15 to 35 bar, preferably approximately 25 to 30 bar, and especially approximately 26 to 28 bar, is reached in the closed pressure tank. Only the tobacco pores are further treated upon the selective condensation of liquid carbon dioxide. When being fed into the pressure tank, the gaseous carbon dioxide used therefor has suitably a temperature of approximately −25° C. to +15° C., preferably approximately −20° C. to +10° C., especially approximately +4° C. to +6° C. The time of contact with the gaseous carbon dioxide in the pressure tank is about 2 to 12 minutes, preferably about 4 to 8 minutes, especially about 6 minutes. In step (b) essentially the weight of the tobacco is increased by approximately 10 to 40 wt.i-% with respect to the initial untreated tobacco through selective impregnation of the pores with liquid carbon dioxide. After this treatment, the impregnated tobacco is at a temperature of, for example, approximately −25° to −45° C.

The filling of the pressure tank with gaseous carbon dioxide is effected through a shutoff valve in the bottom pressure tank. This shutoff valve is in communication with gaseous carbon dioxide through a duct.

After the impregnation of the tobacco with liquid carbon dioxide and prior to the performance of step (c) of the process of the present invention, the carbon dioxide pressure in the pressure tank is reduced as quickly as possible from the former condensation pressure to a substantially lower pressure to convert the liquid carbon dioxide in the tobacco pores to solid carbon dioxide. This sudden reduction, first to approximately atmospheric pressure, may be effected by venting through the same shutoff valve and duct used in step (b) for feeding of gaseous carbon dioxide. After the initial reduction of the pressure in the pressure tank, residual carbon dioxide may be recovered by application of a gentle vacuum. The recovered material may be recycled for further use.

As already mentioned, the expansion causes the conversion of the liquid carbon dioxide contained in the tobacco pores into solid carbon dioxide. At the same time, a part of the initial carbon dioxide is converted to gaseous carbon dioxide. The ratio between solid carbon dioxide and gaseous carbon dioxide obtained in this manner is dependent on the respective process conditions. In general, the weight ratio is approximately 0.2 to 1.0/1, preferably approximately 0.3 to 0.6/1. After step (c) of the process of the present invention, the pores of the treated tobacco contain an amount of solid carbon dioxide of approximately 2 to approximately 17%, preferably approximately 8 to approximately 15%, related to the initial weight of the untreated tobacco.

For reasons of economical operation and optimal utilization of the carbon dioxide, the volume of the pressure tank wherein the steps (b) and (c) are carried out is selected so that the cooled tobacco fills at least two thirds of the pressure tank. A lower or a higher degree of filling may be selected in response to the process conditions and in response to the desired effect.

After step (c) of the process of the invention, the tobacco, having its pores filled with solid carbon dioxide, is removed by opening the bottom of the pressure tank. It is then, optionally, through a correspondingly insulated and, if necessary, cooled supply vessel, introduced into a conventional device for treating tobacco containing solid carbon dioxide with hot gases to achieve the desired expansion. This is step (d) of the process of the present invention. The measures and methods to be applied in this step (d) are known to those skilled in the art. The usual hot gases are preferably air, steam or a mixture thereof. The treatment is at temperatures of usually approximately 150° C. to 350° C., preferably approximately 200° C. to 300° C., during the period of time which is required for the expansion. The time should be as short as possible to avoid damage to the tobacco.

After emptying the pressure tank, the bottom is again closed, returning the communicating duplex tank system to its normal position. The process of the invention may then be repeated.

Due to the large amounts of gaseous carbon dioxide produced during the formation of the cold foggy mixture from the liquid carbon dioxide, it may under certain circumstances be appropriate to withdraw excessive gaseous carbon dioxide prior to the actual performance of step (b). As in the case of the carbon dioxide present in step (c), having additionally been formed from the liquid carbon dioxide, it is recovered in an appropriate manner, e.g., concentrated, cooled and returned again to the carbon dioxide supply vessel. This makes possible the extensive recycling of the carbon dioxide and contributes to a further increase in the profitability of the process. There is lost only that amount of carbon dioxide which is present in the solid state in the tobacco removed from step (c). This latter carbon dioxide is converted to gaseous carbon dioxide in step (d) and is simultaneously mixed with the hot gases which are required for the thermal treatment in order to achieve the expansion of the tobacco. A separation of the gaseous carbon dioxide present in this gas mixture is also possible; however, it is generally not profitable—consequently, this separation is usually renounced.

As far as the steps (a) to (c) are concerned, the process of the present invention can be carried out in a device which is illustrated in the attached diagrammatic and partly sectional view. Step (d) of the process can be carried out by means of a usual device for the expansion of tobacco through treatment with hot gases.

FIG. 1 shows in detail a duplex tank system comprising a horizontally disposed cylindrical mixing tank 1 and an associated vertically disposed cylindrical pressure tank 2. The right-hand portion of the mixing tank 1 houses a conveying means 3 for receiving tobacco 4. The conveying means 3 consists of a bin 5, adapted to receive the required amount of tobacco, a conveyor belt 6 at the bottom side and proportioning rollers 7 at the front side. The bin 5 is supplied with the amount of tobacco to be treated through a feeding aperture 9 including a shutoff member 8.

The pressure tank 2, flanged with its head portion to the bottom of the left-hand portion of the mixing tank 1, comprises an upper lid 10 and a bottom lid 11. The lids can be opened and/or closed independently of each other. The dash-line illustrates the lid 10 in the closed position and the lid 11 in opened position. The bottom of the pressure tank 2 houses a shutoff valve 12 which is connected via a duct 13 to the supply vessel for gaseous carbon dioxide (not shown). This duct 13 allows the pressure tank 2 to be brought to the pressure required for the performance of step (b) of the process through supply of gaseous carbon dioxide. When the carbon dioxide is expanded in performing step (c), it may be evacuated via duct 13. The wall of the pressure tank 2 includes a shutoff valve 15 which communicates via an exhaust duct 14 with a vacuum pump (not shown) and by which the duplex container system is, prior to step (a) of the process, evacuated and freed from unwanted air which is present both in the interior of the duplex tank system and in the tobacco pores. The interior of the pressure tank 2, namely, the inner shell, the lid 10 and the lid 11, is coated with a heat-insulating lining 16. The top end of the left-hand portion of the mixing tank 1 is provided with an expansion valve 17 which is supplied with liquid carbon dioxide through a duct 18 from a supply vessel (not shown). The opening of the expansion valve 17 results in the formation of a foggy mixture 19 of cold gaseous carbon dioxide, carbon dioxide snow and some liquid carbon dioxide which is directly fed into the top-side opening of the pressure tank 2 and mixed with the simultaneously fed tobacco 4.

The performance of steps (a) to (c) of the process of the present invention with the device as shown in FIG. 1 is explained in detail in the following examples.

EXAMPLE 1

Process step (a)

10 kg of cut Virginia tobacco 4 having a humidity of approximately 21% and an ambient temperature (approximately 18° to 22° C.) are filled into the bin 5 of the conveying means 3 of the mixing tank 1 having a tankage capacity of approximately 300 l through the feeding opening 9 with the shutoff member 8 being open. Thereupon, the shutoff member 8 of the mixing tank 1 is closed. With the lid 10 being open and the lid 11 being closed, a duplex tank system (having a total tankage capacity of approximately 450 l) consisting of the mixing tank 1 and the pressure tank 2 having a tankage capacity of approximately 150 l is freed practically of air through application of a vacuum to the exhaust duct 14 provided in the shell of the pressure tank 2 via the shutoff valve 15, i.e., is evacuated until an absolute pressure of approximately 4 mbar has been reached within this duplex tank system. In addition, the air contained in the pores of the tobacco 4 is substantially completely removed. The shutoff valve 15 is then closed.

Thereafter, the expansion valve 17 is opened and set in such a manner that within a period of approximately 6 minutes approximately 8 kg of liquid carbon dioxide are fed through the duct 18 and are converted to a cold foggy mixture of cold gaseous carbon dioxide, carbon dioxide snow and some liquid carbon dioxide. When the expansion valve 17 is opened, the conveyor belt 6 and the associated proportioning rollers 7 are operated such that within a time period of again approximately 6 minutes the total amount of 10 kg of tobacco contained in the bin 5 is uniformly metered into the interior of the pressure tank 2 and is at the same time intermixed and uniformly cooled with the foggy mixture formed through the expansion valve 17.

In the duct 18, which is in communication with a supply vessel, the liquid carbon dioxide is at an absolute pressure of approximately 14 bar and at a temperature of approximately −35° C. During the feeding of the cold foggy mixture through the expansion valve 17 and the intermixture of this mixture with the tobacco 4, the initial pressure of approximately 4 mbar within the duplex tank system is increased to an absolute pressure of approximately 5 bar. This pressure is gradually reduced to an absolute pressure of approximately 0.6 bar by opening the shutoff valve 12 and evacuation through duct 13. At the end of the treatment period of approximately 6 minutes, the tobacco 4 is cooled down to a temperature of approximately −80° C. At this instant, the pressure within the mixing tank 1 and the pressure tank 2 of the duplex tank system is further reduced to an absolute pressure of approximately 0.25 bar through the vacuum pump communicating with duct 13, so that the temperature of the tobacco 4 is rendered more uniform and at the same time additional gaseous carbon dioxide is recovered. The gaseous carbon dioxide withdrawn through duct 13 is recovered and recycled entirely; e.g., it is simply brought to a higher pressure or even converted to liquid carbon dioxide through additional compression. The thus obtained carbon dioxide can therefore entirely be used again and circulated.

Process step (b)

When the desired temperature of −80° C. has been reached, the lid 10 of the pressure tank 2 is closed. Thereupon, shutoff valve 12 is opened and gaseous carbon dioxide ranging between an initial temperature of approximately −15° C. and a final temperature of approximately +15° C. is introduced through the lid 11 via the duct 13 into the pressure tank 2, so that an absolute pressure of approximately 26 bar is generated in the pressure tank 2. The tobacco 4 is treated in the pressure tank 2 for approximately 6 minutes and the tobacco pores are selectively impregnated with liquid carbon dioxide from the condensation of gaseous carbon dioxide. By this impregnation, the tobacco weight is increased by approximately 28 percent, based on the weight of the original untreated tobacco 4.

Process step (c)

The pressure within the pressure tank 2 is first rapidly expanded via duct 13 to an absolute pressure of approximately 1 bar and is then, also via duct 13, evacuated to an absolute pressure of approximately 0.2 bar, whereby the total carbon dioxide present in the pressure tank 2 is recovered. By this expansion, which lasts for approximately 2 minutes, a portion (approximately one-third) of the liquid carbon dioxide contained substantially in the pores of the tobacco 4 is converted to solid carbon dioxide, whereas the other portion (approximately two thirds) is evaporated to gaseous carbon dioxide. After the expansion and the evacuation, the lid 11 of the pressure tank 2 is opened and the tobacco containing solid carbon dioxide in its pores is removed. Like the initial charge, the thus obtained tobacco is a free-flowing material whose fibers are not iced together. Therefore, no mechanical treatment of this tobacco is required in order to break up the material.

Process step (d)

The tobacco 4 containing solid carbon dioxide is expanded in a usual tobacco expansion device at a temperature of approximately 250° C. with a mixture of air and steam, whereby the tobacco 4 obtains a filling capacity of approximately 11.4 $cm^3/g$, the initial tobacco having a filling capacity of 5.5 $cm^3/g$. These data have been ascertained according to the filling capacity test of Borgwaldt with the tobacco having a humidity of 12.6%.

The fiber length of the processed tobacco is practically unchanged in comparison to the initial tobacco. The amount of tobacco is approximately 99.7 percent by weight, relative to the initial weight of the tobacco. This shows that the process of the present invention does not entail a substantial loss of tobacco, e.g., caused by abrasion, any other comminution or any other influences. The aroma of the treated tobacco remains practically the same.

EXAMPLES 2 TO 7

As in example 1, further samples of Virginia tobacco having an initial humidity of 21% are treated in the duplex tank system. The process conditions are different from those of example 1. The test results obtained are shown in the following table.

TABLE

| Example No. | 2 | 3 | 4 | 5 | 6 | 7 |
|---|---|---|---|---|---|---|
| Tobacco amount (kilos) | 10 | 10 | 10 | 10 | 10 | 10 |
| Consumption of liquid carbon dioxide in step (a) | 4 | 5.3 | 6.7 | 7.5 | 8.4 | 7.55 |
| Cooling of the tobacco in step (a) to °C. | −31 | −52 | −63 | −79 | −90 | −78 |
| Absolute pressure of the gaseous carbon dioxide in step (b) (bar) | 26 | 26 | 26 | 26 | 26 | 30 |
| Amount of solid carbon dioxide (%) contained in the tobacco pores at the end of step (c) | 2.5 | 3.7 | 8.2 | 12 | 15 | 12.8 |
| Filling capacity ($cm^3/g$) | 8.5 | 9.35 | 10 | 10.67 | 10.83 | 11.04 |
| Humidity (%) | (12.6) | (12.5) | (12.1) | (12.63) | (12.8) | (12.53) |

The other properties of the tobacco obtained according to the aforementioned examples 2 to 7 are identical with the additional properties as mentioned under example 1.

I claim:

1. A process for the expansion of tobacco which comprises:

(a) directly in a closed system containing tobacco, expanding pressurized liquid carbon dioxide so as to initially form a mixture of gaseous carbon dioxide, solid carbon dioxide particles and, optionally, liquid carbon dioxide so as to cool the tobacco to between −30° C. and −100° C., the weight ratio of pressurized liquid carbon dioxide to tobacco introduced into said closed system being such that the thus-cooled tobacco contains not more than 10% by weight of solid carbon dioxide particles;

(b) compressing, under a pressure of from 15 to 35 bar, gaseous carbon dioxide in the presence of the cooled tobacco so as to form an amount of liquid carbon dioxide just sufficient to impregnate the pores of the cooled tobacco;

(c) converting the liquid carbon dioxide impregnated in the tobacco to solid carbon dioxide and simultaneously gaseous carbon dioxide through rapid reduction of the carbon dioxide pressure; and (d) subjecting the tobacco containing the solid carbon dioxide to a hot gas treatment to achieve the expansion.

2. The process of claim 1 wherein the weight ratio of the pressurized liquid carbon dioxide to tobacco is such that the cooled tobacco contains substantially no solid carbon dioxide particles.

3. The process of claim 1 wherein the weight ratio of liquid carbon dioxide to tobacco in the closed system of step (a) is approximately 0.7 to 1.0 based on the weight of tobacco.

4. The process of claim 1 wherein the weight ratio of liquid carbon dioxide to tobacco in the closed system of step (a) is approximately 0.4 to 1.0 based on the weight of tobacco.

5. The process of claim 1 wherein, in step (a), the tobacco is cooled to a temperature of from about −70° C. to −85° C.

6. The process of claim 1 wherein the pressurized liquid carbon dioxide is expanded to an absolute pressure of less than approximately 6 bar.

7. The process of claim 1 wherein the pressurized liquid carbon dioxide is expanded to an absolute pressure of from 0.2 to 1.0 bar.

8. The process of claim 1 wherein the closed system comprises a mixing tank connected to a pressure tank and the tobacco and the mixture of step (a) are fed directly through the mixing tank into the pressure tank.

9. The process of claim 1 wherein step (b) is carried out in a pressure tank, the interior of which is provided with a heat-insulating lining.

10. The process of claim 8 wherein said mixing tank and said pressure tank form a communicating pressure-tight and vacuum-tight duplex tank system.

11. The process of claim 10 wherein said duplex tank system is evacuated prior to the formation of the mixture of step (a) and prior to the intermixture thereof with the tobacco.

12. The process of claim 10 wherein said duplex tank system is evacuated to a pressure of approximately 3 to 8 mbar.

13. The process of claim 10 wherein said duplex tank system is evacuated to a pressure of approximately 4 to 6 mbar.

14. The process of claim 1 wherein said mixing tank comprises a conveying means for receiving the required amount of tobacco and conveying the tobacco to said pressure tank, said conveying means conveying the tobacco at a rate responsive to the amount of liquid carbon dioxide consumed and the amount of the mixture formed.

15. The process of claim 1 wherein said pressure tank is provided with pressure-tight and vacuum-tight upper and lower lids.

16. The process of claim 1 wherein the cooled tobacco is treated in step (b) in a closed pressure vessel maintained at a gaseous carbon dioxide pressure of approximately 25 to 30 bar.

17. The process of claim 16 wherein, when being fed into the pressure vessel of step (b), the gaseous carbon dioxide has a temperature of approximately −25° C. to +15° C.

18. The process of claim 16 wherein, when being fed into the pressure vessel of step (b), the gaseous carbon dioxide has a temperature of approximately −5° C. to +10° C.

19. The process of claim 1 wherein the contact time with the gaseous carbon dioxide in step (a) is approximately 2 to 12 minutes.

20. The process of claim 1 wherein the weight of the tobacco is increased in step (b) by approximately 10 to 40% by the impregnation with liquid carbon dioxide.

21. The process of claim 1 wherein, in step (c), the carbon dioxide pressure is rapidly reduced to approximately atmospheric pressure to convert at least a portion of the liquid carbon dioxide in the pores of the tobacco to solid carbon dioxide.

22. The process of claim 1 wherein the carbon dioxide present in the pressure tank and the gaseous carbon dioxide formed through expansion of the liquid carbon dioxide contained in the tobacco pores are recovered and recycled through the process under a slight vacuum.

23. The process of claim 1 wherein, in step (d), the hot gases are at a temperature of approximately 150° C. to 350° C.

24. The process of claim 1 wherein, in step (d), the hot gases are at a temperature of approximately 200° C. to 300° C.

* * * * *